United States Patent [19]

Parke

[11] Patent Number: 4,631,826

[45] Date of Patent: Dec. 30, 1986

[54] HANDPIECE FOR SHEARING EQUIPMENT

[76] Inventor: Terence J. Parke, 11 Craigmore Pl., Melton, Victoria, Australia

[21] Appl. No.: 541,655

[22] Filed: Oct. 13, 1983

[51] Int. Cl.[4] ..... B26B 19/14

[52] U.S. Cl. ..... 30/207; 30/264; 30/276

[58] Field of Search ..... 30/206, 210, 223, 240, 30/241, 264, 276, 287, 207, 213, 214, 221, 266; 83/583, 592, 594, 595

[56] References Cited

U.S. PATENT DOCUMENTS

| | | | |
|---|---|---|---|
| 616,214 | 12/1898 | Underwood | 30/240 X |
| 795,550 | 7/1905 | Schum | 30/223 X |
| 2,532,174 | 11/1950 | Lieberman | 30/206 X |

FOREIGN PATENT DOCUMENTS

| | | | |
|---|---|---|---|
| 2023051 | 12/1979 | United Kingdom | 30/223 |

*Primary Examiner*—Douglas D. Watts

*Attorney, Agent, or Firm*—Cushman, Darby & Cushman

[57] ABSTRACT

According to one embodiment of the present invention there is provided a handpiece for shearing wool from sheep, but not restricted to this use, comprising a body portion, a cutting element resiliently mounted to the body portion, the body portion having a combing finger projecting therefrom for directing the material to be cut towards the cutting element, an abutment bar for locating the material with respect to the cutting element, a rotary blade having a plurality of teeth movable relative to the cutting element and the abutment bar, the abutment bar being spaced from the cutting element to define a space between the cutting element and the abutment bar in which at least a portion of the rotary blade may move. The rotary blade, the abutment bar and cutting element being arranged so that in use the rotary blade and cutting element cooperatively interact to cut the material with the rotary blade moving the material for cutting into engagement with the cutting element and abutment bar to facilitate the cutting of the material.

20 Claims, 16 Drawing Figures

HANDPIECE FOR SHEARING EQUIPMENT

This invention relates to a handpiece for shearing equipment which may be used for shearing hair, fur, wool, or the like from animals or humans, and may find application in cutting synthetic fibres. In particular the present invention is used in shearing wool from sheep. Although the description of the invention illustrates this particular application, the scope of the invention is not so limited.

Previously available handpieces used to shear sheep have been heavy and cumbersome requiring a great deal of effort and energy to power and manoeuvre them. These disadvantages have been caused by the cutter mechanism reciprocating with respect to the combing fingers. The limitations of the reciprocatory motion are well known and include the problems of the cutter producing vibrations in the handpiece; the cutters and combs requiring regular replacing or sharpening; and injuries to the sheep can often occur.

It is an aim of the present invention to provide a shearing handpiece which at least in part alleviates some of the problems inherent in previously available shearing handpieces.

According to the present invention there is provided a handpiece for shearing equipment comprising a body portion, a cutting element resiliently mounted to the body portion, the body portion having a combing means projecting therefrom for directing material to be cut towards the cutting element, an abutment means for locating the material with respect to the cutting element, a blade means movable relative to the cutting element and the abutment means, the abutment means being spaced from the cutting element to define a space between the cutting element and the abutment means in which at least a portion of the blade means may move, the blade means, abutment means and cutting element being arranged so that in use the blade means and cutting element cooperatively interact to cut the material with the blade means moving the material for cutting into engagement with the cutting element and abutment means to facilitate the cutting of the material.

Preferably, the cutting element is resiliently carried by the combing means.

Preferably, the combing means is substantially rigid and has a plurality of comb fingers arranged around the forward end of the handpiece, the tip portions of which are substantially coplanar and parallel to each other. Preferably, the ends of the top portions are formed with rounded points or cusps.

In one embodiment at least some of the fingers have a bifurcated section in which the upper arm of the bifurcated section constitutes the shank of the finger, and the lower arm defines the abutment means.

In one embodiment the abutment means is in the form of a substantially flat section extending inwardly in a plane substantially parallel to the plane of the lower surfaces of the tip portions. A web portion connects adjacent pairs of the abutment means to form a substantially flat U-shaped section.

In one embodiment the blade means is a rotatable disc having a plurality of generally radially directed arcuate teeth each having a leading edge and a trailing edge shaped so that the teeth are swept back with respect to the normal direction of rotation of the blade in use. More preferably, the teeth of the disc have two portions, the two portions being an upper portion which overlies a lower portion defining a space therebetween, the upper portion being slightly wider and longer than the lower portion and the free end of both portions being rounded so as to present a smooth surface to the material.

In one embodiment the abutment means is received into the space defined by the upper portions and lower portions of the teeth.

Another aspect of the present invention provides for a combing means which may be used in the handpiece of the present invention. According to this aspect of the present invention there is provided a combing means for use with a handpiece, the handpiece having a blade means, the combing means comprising a substantially rigid body portion which presents an array of forwardly extending fingers arranged generally in a common plane, the body portion being adapted to allow the blade means of the handpiece to move in a plane generally parallel to the common plane, an array of cutting elements, respective ones of which are positioned so as to be in use between the blade means and the respective ones of the fingers, said cutting elements being resiliently mounted on the body portion for resilient engagement in use with the blade means of the handpiece to effect cutting of the material by co-operative interaction of the blade means and the cutting element, and an abutment means extending inwardly of the combing means in a plane generally parallel to the common plane to locate material prior to it being cut.

Preferably, the body portion is adapted to receive the blade means to allow the blade means to rotate with respect to the cutting elements.

Preferably, the majority of the fingers of the combing means include a shank portion and a tip portion, the forward end of the respective fingers being the tip portion which is formed as a rounded point or cusp by the termination of the upper surface of the tip portion with the lower surface of the tip portion.

The lower surface of the tip portion is continuous with or has attached to it a bar section substantially aligned with the respective shank portion so as to define a space bounded by the underside of the shank portion, the upper surface of the bar section, and the rear surface of the tip portion, in which in use at least a portion of the blade means may rotate.

Preferably, the cutting element in one embodiment comprises a plurality of identical cutting element each being a blade, respective ones being resiliently attached to respective fingers along the respective side or underneath surfaces of the fingers. Preferably, the lowermost surface of the cutting elements is a sharpened edge which is bevelled.

The present invention will now be described by way of example with reference to the accompanying drawings in which.

Figure 9:
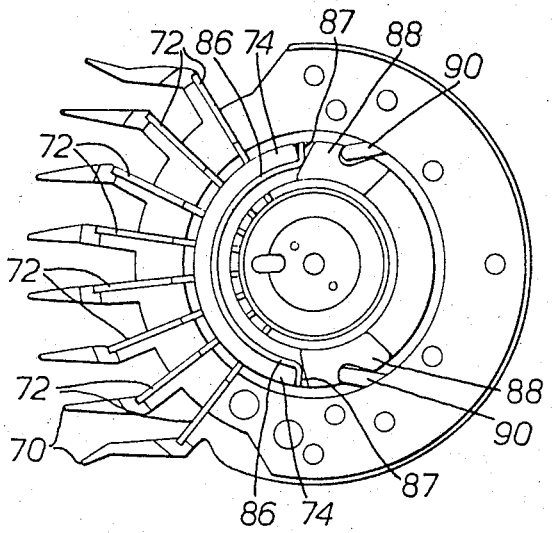
FIG. 9 is an underneath view of an alternative embodiment of the handpiece of the present invention similar to the view of FIG. 3 with the guard plate removed to reveal the relationship of the working components inside the handpiece.
Figure 10:
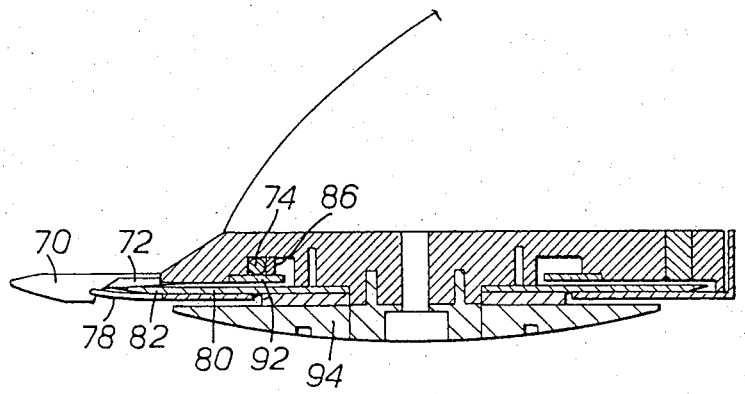
FIG. 10 is a cross-sectional view through the alternative embodiment of the hand piece with the guard plate and lower plate assembled.
Figure 11A:
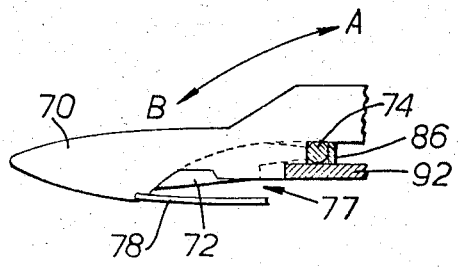
Figure 11B:
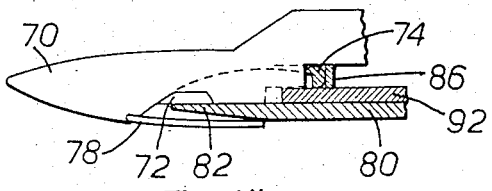
Figure 12:
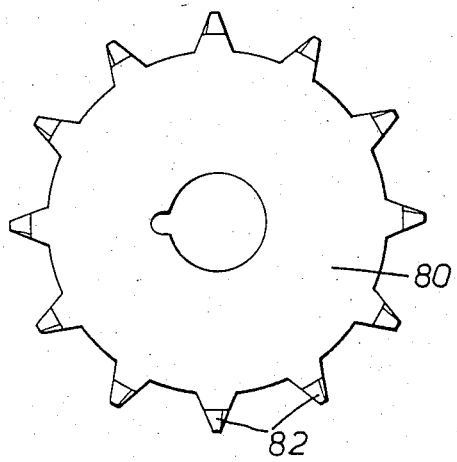

FIGS. 11*a* and 11*b* are more detailed views of one finger of FIG. 9 showing two positions of the cutting blade an instant apart;

FIG. 12 is a plan view of one embodiment of the blade means of the alternative embodiment of the hand piece.

Figure 1:
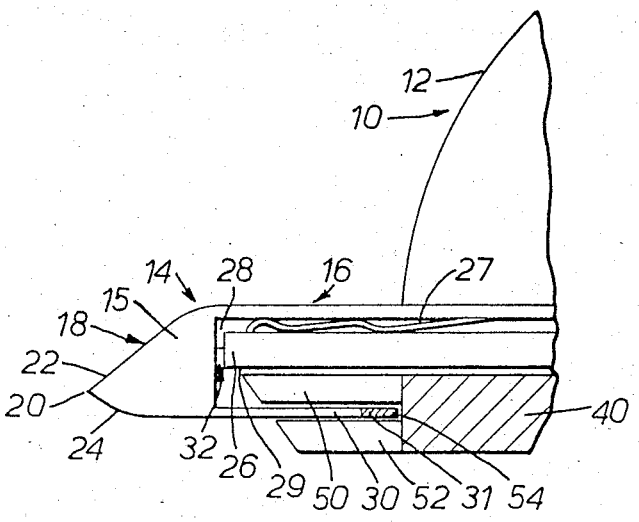
FIG. 1 is a fragmentary cross-sectional view of a preferred embodiment of the handpiece taken along the line 1—1 of FIG. 2.
Figure 2:
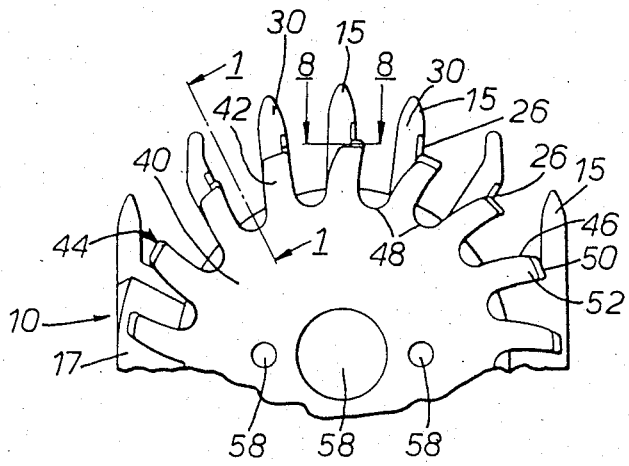
FIG. 2 is a fragmentary underneath view of the handpiece of FIG. 1.
Figure 3:
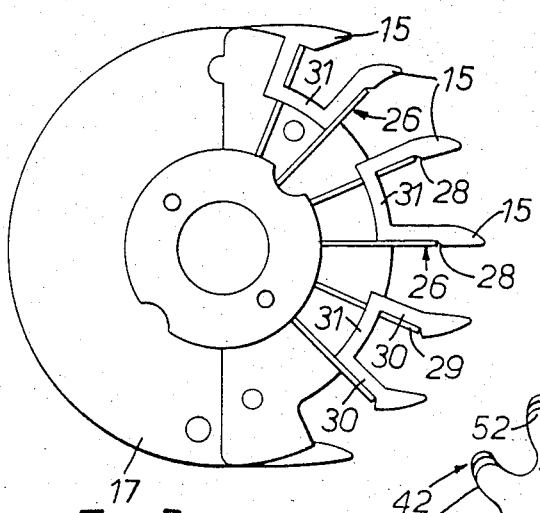
FIG. 3 is an underneath view of the handpiece of FIG. 1 with a rotary blade removed to reveal the lower cutting edges of the cutting elements.
Figure 6:
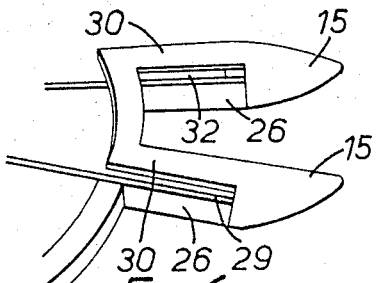
FIG. 6 is a close-up view of two adjacent fingers of the combing means together with respective cutting elements located along the sides of the fingers.
Figure 7:
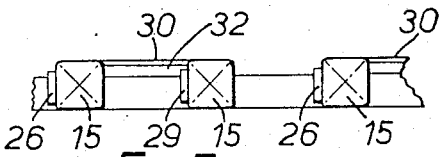
FIG. 7 is a fragmentary end view of the combing means showing three adjacent fingers with respective cutting elements attached and an abutment means between the left hand side finger and the central finger.

In FIGS. 1 and 2 there is shown a handpiece 10 having a forward portion 12 which is substantially dome-like in shape. The rear of the handpiece has been omitted from the drawings to more clearly illustrate the inventive concept of the present invention. The combing means 14 comprises, a body 17 and a plurality of fingers 15 of which a single finger is shown in FIG. 1. Each finger has a shank portion 16 and a tip portion 18. Shank portion 16 extends from the body 17 of the combing means to the tip portion which terminates in a rounded point 20 formed by the convergence of upper surface 22 with lower surface 24. Referring now to FIGS. 3, 6 and 7, in addition to FIGS. 1 and 2, a cutting element 26 made from a strip of tempered steel is located in a recessed groove 28 along a side surface of the shank portion of each finger. However, it is to be noted that the cutting element may be located in a recessed groove along the underside of the shank. The lower surface of the cutting element is a sharpened edge 29 which in use of the handpiece is used to cut the fibres of wool.

The cutting elements are resiliently mounted on the combing means in grooved recesses 28 of corresponding fingers by any convenient means such as a spring clip, leaf spring, strips of resilient material or the like. A leaf spring 27 is illustrated in FIG. 1.

A flat bar 30 extends inwardly into the handpiece from the rear of the tip portion to define a space 32 between the lower surface of the shank portion and the upper surface of the flat bar. The flat bar acts as an abutment means for fibres of material being cut by the handpiece.

Sharpened edge 29 of the cutting element protrudes into space 32 for resilient engagement against a rotary blade 40 which will be described in more detail later.

With particular reference to FIG. 3, fingers 15 are arranged in a single plane and project forwardly from the handpiece. Pairs of adjacent bars 30 are joined by web 31 so that the lower surfaces of the tip portions of adjacent fingers have substantially planar U-shaped abutment means. It is to be noted that the abutment means may be of any form suitable for the function served by it.

Figure 4:
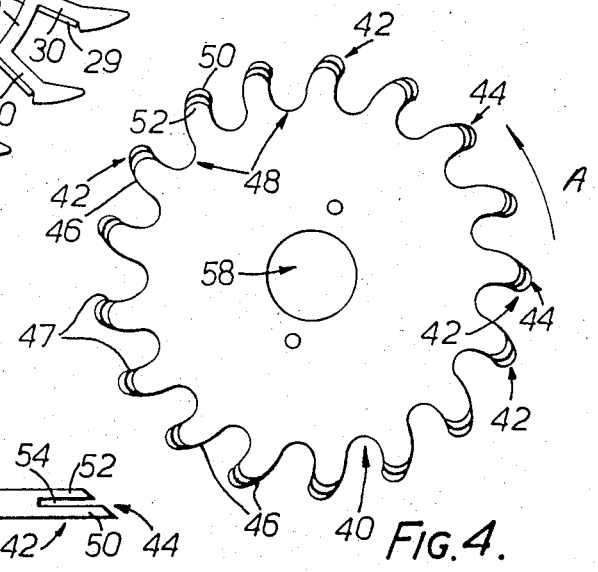
FIG. 4 is an underneath view of the rotary blade removed from the handpiece.
Figure 5:
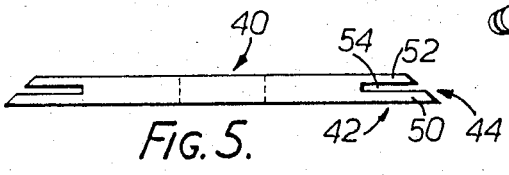
FIG. 5 is a cross-sectional view of the rotary blade of FIG. 4.

Turning now to FIGS. 4 and 5 which illustrate one embodiment of the rotary blade in more detail, blade 40 comprises a number of generally radially outwardly extending arcuate teeth 42 located around the circumference of a disc. Each tooth comprises a leading edge 46, a trailing edge 47 and a root 48, arranged so that the tooth is swept back from the normal direction of rotation of the blade which is shown by arrow A. The free end of each tooth is rounded, as is the root 48 between any two adjacent teeth so that in operation no discontinuous surface or surfaces that meet at a point or at the apex or cusp of an angle are presented to the fibres being cut so as to avoid the fibres being snagged or tangled. A hole 58 is provided at the centre of the disc for receipt of a shaft assembly for rotating the blade 40. Turning in particular to FIG. 5, the teeth of the rotary blade are each divided into two portions, an upper portion 50 and a lower portion 52. The upper overlies the lower portion and is slightly wider and slightly longer than the lower portion. The edges of the upper and lower portions are rounded along their respective free ends 44 and leading edges 46, but not along their respective trailing edges 47.

The upper and lower portions of each tooth are spaced apart from each other to define a space 54 between them. The blade and the combing means are arranged so that the upper portion of each tooth may rotate in space 32 whereas flat bar 30 projects into space 54, thus enabling the blade to freely rotate with respect to the comb means, as best seen in FIG. 1.

In operation, the handpiece is driven by compressed air or electricity such that rotary blade 40 rotates with respect to the cutting elements.

The operation of the handpiece will now be described with reference to FIG. 8 which is an end view of the handpiece when viewed looking towards the fingers. A wool fibre 60 is shown in relation to the cutting element 26, abutment means 30, and a tooth of the blade in a number of positions in timed sequence showing how the fibre is tensioned prior to cutting it cleanly with the upper portion 50 of a single tooth. It is to be noted that all operations occur almost simultaneously as the blade is rotating rapidly in the handpiece and the cutting of the fibres occur at all of the cutting elements simultaneously.

Figure 8A:
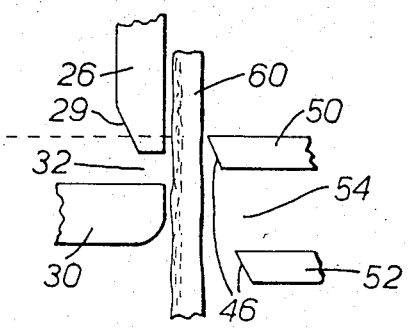
FIG. 8 is a series of schematic views taken along the line 8—8 showing the sequence of operations as one tooth passes a cutting element.
Figure 8B:
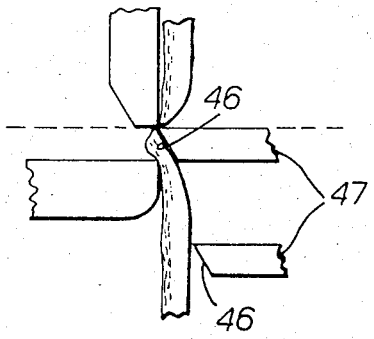
Figure 8C:
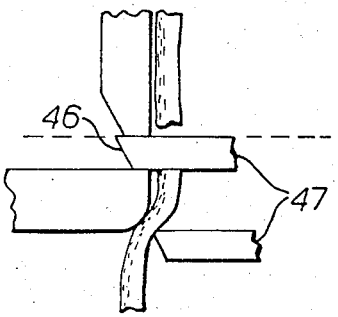
Figure 8D:
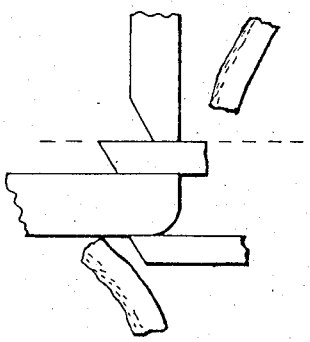

Assume that the root 48 between two adjacent teeth of the blade is located immediately under the cutting element, as shown in FIG. 8*a*, and consequently the adjacent tooth allows wool fibre 60 between it and the plane formed by the cutting element 26 and flat bar 30. In this position the cutting element will be at its lowermost position as it is resiliently urged downwards by the leaf spring 27 (not shown in FIG. 8). As the blade rotates, one of the teeth of the blade approaches the cutting element so that there is a point to point contact between a point on the sharpened edge of the cutting element and a point on the leading edge of the top portion of the tooth. As the blade continues to rotate the point to point contact travels along the length of the sharpened edge of the cutting element and along the leading edge of the upper portion of the tooth. Thus, the cutting element is forced slightly upwards against the bias of the leaf spring as shown in FIG. 8*b*, thereby ensuring that there is a good cutting action between the edge of the tooth and the cutting element. Any fibres which are located between the sharpened edge of the cutting element and the tooth are thereby cut. As the blade rotates further the upper portion of the tooth passes between the cutting element and the flat bar whereas the lower portion of the tooth passes under the flat bar as shown in FIG. 8*c* because of the provision of respective spaces 32 and 54 described earlier. The fibres which have been directed to abut against the abutment means by the rotation of the blade, are slightly tensioned between the sharpened edge of the cutting element at one end and the flat bar at the other end by the upper portion of the tooth contacting the intermediate portion of the fibre which is illustrated in FIG. 8*b*. Thus, the slight tension on the fibre immediately prior to it being cut facilitates greatly the cutting of the fibre more cleanly which is illustrated in FIG. 8*c*. In addition, the co-operation between the lower portion of the tooth and the flat bar facilitates removal of the fibres remaining on the sheep being thrown away from the rotating blade after the fibres have been cut which is illustrated in FIG. 8*d*, thus preventing any loose ends of the fibres from being entangled in the rotating blade and being wound around the rotating blade to stall the handpiece. The fibres immediately after they have been cut are pushed away from the cutting element by the rounded free end of the tooth, thus clearing the cutting element and removing the cut fibres which have had a tendency in the past when using other types of shearing handpieces to become entangled around the rotating or moving blade of the handpiece, away from the rotating blade, thus preventing stalling of the handpiece.

It is to be noted that any fibres which are uncut by the interaction of the rotating blade and the cutting element, are pushed away from the rotating blade by the uncut fibres abutting against web 31 of flat bar 30. Due to the shape of roots 48 of the teeth of the rotating blade being curved any uncut fibres located between the roots and the flat bar are pushed to abut against web 31 which prevent the fibres from being wound around the rotating blade to stall the handpiece or from being caught between the blade and the handpiece. As the blade continues to rotate, the curved shape of the roots of the teeth together with the curvature of the edges of the teeth co-operate to push the uncut fibres outwardly away from the web and thus, the fibres are not caught in the blade.

One modification of the present invention is that the rotating blade may be mounted above or below the common plane of the fingers of the handpiece. Another modification to the present invention is that the blade may oscillate with respect to the fingers so that both reciprocating and rotary movement of the blade with respect to the fingers is within the scope of the present invention. Another modification to the present invention is that the handpiece may be constructed so that the fingers extend perpendicularly to the rotating blade.

Advantages of the present invention include that the handpiece is capable of continuous running for lengthy periods of time without the need for maintenance and disassembling the handpiece to sharpen the blade or the cutting element.

The handpiece runs cooler than conventional handpieces, even after lengthy periods of continuous running, which enables the handpiece to be used on smaller animals such as goats as well as on sheep. The cooler running of the handpiece of the present invention results from less friction between the cutting element and rotating blade than between the comb and blades of conventional handpieces since the contact is point to point contact rather than surface to surface contact.

The cutting mechanism described hereinbefore is particularly suitable for being used in automated sheep shearing equipment.

It should be readily appreciated that the combing means described herein, although described specifically in relation to use with equipment for cutting wool could readily be adapted for use with equipment for cutting material, such as cloth or hair, or be adapted for use in the rag trade for cutting material. In one modification for cutting material in the rag trade the handpiece is provided with two fingers projecting forwardly from the handpiece for directing material in to contact with a cutting wheel which is arranged to rotate in a plane at right angles to the material. In this manner, the rotary shear handpiece mode in accordance with the present invention may be used to cut material efficiently and without fatiguing the operator. In this modification, the common plane of the fingers and the rotating cutting wheel is at right angles to the plane of the material whereas in the foregoing described embodiment the plane of the wool being shawn from the sheep is parallel to the common plane of the wheel and fingers.

In the alternative embodiment of the handpiece shown in FIGS. 9 to 12, the salient features of the handpiece are a plurality of forwardly directed fingers 70, each finger having a slot (not shown) located in its underside surface in which a movable cutting element 72 is housed. Each cutting element is held in the corresponding slot under tension which is provided by an adjustable resilient biasing means in the form of a short length of rubber 74.

Each finger 70 is provided with a tip portion and a reduced thickness shank portion so that the undersurface is stepped into the finger. A guard plate (not shown) having a corresponding number of forwardly directing prongs 78 is assembled with the handpiece in such a manner that the prongs 78 which are relatively thin, form a common plane with the undersurface of the tip portions of the fingers 70, and the respective prongs 78 and reduced thickness shank portions of each finger are spaced apart to define a gap 77. The prongs act as an abutment means in this embodiment for a rotary blade 80 which is assembled in the handpiece to rotate in the gap. A preferred form of the rotary blade having a plurality of radial teeth 82 is shown in FIG. 12.

The following description will refer to one of the fingers and associated components, although it is to be noted that there is a plurality of such fingers. The movable cutting element 72 which slightly projects edgewisely from the slot is generally crescent shaped with a stepped tail portion 84 and is substantially planar. The lower edge which projects from the slot is sharpened along its forward part so that when this edge contacts the teeth of the rotary blade the wool fibres are cut. The tail portion 84 which is recessed with respect to the forward sharp edge, engages the resilient biasing rubber strip 74. The movable cutting element rocks back and forth inside the slot during the cutting operation as may be seen in more detail in FIGS. 11*a*, 11*b*. The resilient biasing means is a preferably solid rubber strip, such as for example, of neoprene or polyurethane, curved into a substantially semi-circular configuration by means of a spring steel band 86. The spring steel band 86 is in the form of a semi-circle having a flange 87 at either and so that the rubber strip is bordered by the spring band on three sides whereas it is in contact with the cutting elements on the forth side as shown in FIG. 9. Adjustable stops 88 abutting against the flanges 87 at either end are provided to adjust the tension of the steel spring band and hence the cutting elements via the rubber strip. Adjustment of the stops is effected by means of grub screws 90 as shown. The rubber strip 74 acting as resilient biasing means and spring band 86 are securely held in place by means of a snap-fit locking plate 92. A circular cover plate 94 is fitted to the handpiece on the lowermost surface to provide protection from the rotating blade and to prevent damage to the operating mechanism of the handpiece.

In operation, blade 80 rotates so that teeth 82 rotate in turn in the gaps 77 defined by prongs 78 and cutting elements 72. In FIG. 11*a*, the position of blade 80 is shown in the instant when two adjacent teeth 82 are located on either side of a particular cutting element 72. In this instant the particular cutting element is biased by rubber strip 74 to its lower forward position in the slot. As the blade 80 continues to rotate, the next tooth 82 contacts the lower edge of the cutting element forcing it into the slot in the direction of arrow A of FIG. 11*a*. The cutting element 72 is pushed further into the slot to its upper rearward position against the rubber strip 74 until the tooth is positioned immediately under the lower edge of the cutting element as shown in FIG. 11*b*. During this operation, any wool fibres located between the cutting element and the blade are severed. As the blade 80 continues to rotate the tooth 82 travels past the cutting element so that the cutting element is forced in the direction of arrow B of FIG. 11*a* to return to its lower forward position by the resilience of rubber strip 74. Thus, as blade 80 rotates and teeth 82 are in turn rotated past each cutting element, the cutting elements in turn rock between a lower forward position and upper rearward position in turn, thereby effecting cutting of any wool fibres directed onto the cutting elements by the forwardly facing fingers. The prongs 78 acting as abutting means work in a fashion similar to that described previously in relation to FIG. 8*a* to facilitate severing of the wool fibres.

Many modifications will be apparent to those skilled in the art without departing from the spirit and scope of the invention.

I claim:

1. A cutting handpiece comprising a body portion having a combing means projecting therefrom for guiding material for cutting towards a blade assembly, said combing means including a plurality of generally parallel forwardly directed fingers having rounded tip portions at their respective free ends and having lower surfaces, at least some of the fingers having a bifurcated section in which an upper arm of the bifurcated section constitutes the shank of the finger and in which a lower arm defines an abutment means, there being a web portion connecting adjacent pairs of the abutment means to form a substantially flat U-shaped section, said blade assembly including a first movable cutting element resiliently carried by the combing means, a second movable blade means connected to the body portion so as to be opposed by the lower surfaces of the fingers, said second blade means being movable relative to the first cutting element, and the abutment means being spaced from the cutting element to define a space in which at least a portion of the blade means may move, said blade means and said cutting element being arranged to cooperatively engage with each other to cut material located between them in use.

2. A handpiece as claimed in claim 1, wherein the abutment means are in the form of a substantially flat sections extending inwardly from the tip portions in a plane substantially parallel to the plane of the lower surfaces of the tip portions.

3. A handpiece as claimed in claim 1, in which the abutment means comprises a guard plate having a plurality of forwardly directed prongs, the guard plate being connected to the body portion of the handpiece such that the space in which the second blade means may move is defined between the prongs and the under surface of the fingers of the combing mcans.

4. A handpiece as claimed in claim 3 in which the number of comb fingers corresponds to the number of prongs.

5. A handpiece as claimed in claim 4 in which each finger comprises a shank portion of reduced thickness relative to the tip portion so that the lower surface of the finger is stepped, the prongs of the guard plate being coplanar with the lower surface of the tip portion.

6. A cutting handpiece comprising a body portion having a combing means projecting therefrom for guiding material for cutting towards a blade assembly, said combing means including a plurality of generally parallel forwardly directed fingers having rounded tip portions at their respective free ends and having lower surfaces, said blade assembly including a first movable cutting element, including a plurality of substantially identical elongated first planar cutting blades which are resiliently connected to respective fingers along the lower surfaces thereof and which are each provided with a sharp crescent-like or cusp-like shape at one end and with a stepped end having a shoulder at another end, a second movable blade means connected to the body portion so as to be opposed by the lower surfaces of the fingers, and an abutment means fixedly connected to the body portion, said second blade means being movable relative to the first cutting blades, and the abutment means being spaced from the first cutting blades to define a space in which at least a portion of the second blade means may move, said second blade means and said first cutting blades being arranged to cooperatively engage with each other to cut material located between them in use.

7. A handpiece as claimed in claim 6 in which the first planar cutting blades are mounted in slots of respective fingers located along the undersurface of the fingers and extend at least in part into the space defined by the abutment means in which the blade means may move.

8. A handpiece as claimed in claim 7 in which the first planar cutting blades have sharpened edges, and the blades are collectively arranged so as to present the sharpened edges into the space which the blade means may move.

9. A handpiece as claimed in claim 6 in which a shoulder is provided for engaging a resilient biasing means located in the handpiece to effect the resilient mounting of the planar blade so as to apply a tension to the planar blade.

10. A handpiece as claimed in claim 9 in which the resilient biasing means is a semi-circular shaped spring means comprising a length of resilient material contiguous with a spring.

11. A handpiece as claimed in claim 10 wherein the resilient biasing means is provided with adjustment means to alter the tension applied to the first planar blades.

12. A handpiece as claimed in claim 7 including means mounting the first planar blades for movement back and forth inside the slot to effect cutting of the material.

13. A handpiece as claimed in claim 12 wherein the first planar blades move simultaneously at right angles and in the same plane as the slot in a back and forth motion so as to describe a substantially arcuate rocking motion.

14. A handpiece according to claim 1 including means mounting the second blade means for rotation within the space defined by the abutment means and relative to the first cutting element.

15. A handpiece as claimed in claim 14 in which the second blade means is a disc having plurality of teeth located radially around the circumference of the disc and the teeth are generally of a truncated triangular configuation, in which the leading edge with respect to the direction of rotation is sharpened for engagement with the cutting element.

16. A handpiece as claimed in claim 13 in which the disc rotates in a plane located at right angles to the plane of movement of the first cutting elements.

17. A handpiece as claimed in claim 16 in which the teeth of the second blade means engage the plurality of first planar cutting blades of the cutting element and face the latter to move as the plurality of teeth rotate past the plurality of planar blades in use.

18. A handpiece according to claim 8 in which movement of a leading sharpened edge of the teeth of the blade means against the sharpened edges of the plurality of planar cutting blades of the cutting element effects cutting of material located between the blade means and cutting means.

19. A handpiece as claimed in claim 13, wherein the teeth of the disc have two portions, said two portions being an upper portion which overlies a lower portion defining a space therebetween, the upper portion being slightly wider and longer than the lower portion and the free end of both portions being rounded so as to present a smooth surface to the material to be cut.

20. A handpiece as claimed in claim 19 wherein, the abutment means is received into the space defined by the upper portions and lower portions of the teeth.

* * * * *